US006170195B1

(12) United States Patent
Lim

(10) Patent No.: US 6,170,195 B1
(45) Date of Patent: Jan. 9, 2001

(54) DOOR ASSEMBLY

(76) Inventor: Choo Siong Lim, No. 21 Parry Avenue, Singapore (SG), 547247

( * ) Notice: Under 35 U.S.C. 154(b), the term of this patent shall be extended for 0 days.

(21) Appl. No.: 09/334,443

(22) Filed: Jun. 16, 1999

(30) Foreign Application Priority Data

Jun. 18, 1998 (SG) ..... 9801460

(51) Int. Cl.[7] ..... E05D 15/22
(52) U.S. Cl. ..... 49/196; 49/141; 49/409
(58) Field of Search ..... 49/196, 164, 154, 49/155, 409, 141, 127, 128, 129, 130; 160/211, 225

(56) References Cited

U.S. PATENT DOCUMENTS

| | | | | |
|---|---|---|---|---|
| 704,887 | * | 7/1902 | Low | 160/211 |
| 4,305,227 | * | 12/1981 | Georgelin | 49/164 |
| 4,619,074 | * | 10/1986 | Lueng | 49/196 |
| 4,635,699 | * | 1/1987 | Kauffman et al. | 160/211 |
| 5,893,181 | * | 4/1999 | Moncaster | 160/211 |

FOREIGN PATENT DOCUMENTS

| | | | | |
|---|---|---|---|---|
| 4425286 | | 11/1995 | (DE) . | |
| 2249233 | | 10/1973 | (FR) . | |
| 1481457 | * | 2/1974 | (GB) | 49/127 |
| 1481457 | | 7/1977 | (GB) . | |

OTHER PUBLICATIONS

Austrian Search Report dated Feb. 17, 1999.

* cited by examiner

*Primary Examiner*—Jerry Redman
*Assistant Examiner*—Curtis A. Cohen
(74) *Attorney, Agent, or Firm*—Abelman, Frayne & Schwab

(57) ABSTRACT

A door assembly which includes a door frame defining an opening and a door. The door includes a first rectangular panel which is rotatably mounted to the door frame and moveable between an open and a closed position. A second panel is connected to and rotatable with the first panel and is disposed generally parallel to, or co-planar with the first panel and moveable thereto in plane of the panels so as to be moveable between a retracted position where the second panel is generally laterally adjacent to the first panel, to an extended position where the second panel is spaced from the first panel in the direction of the plane of the panels. The door assembly is operative to cover the opening defined by the door frame by movement of the first panel from its open to its closed position and movement of the second panel from its retracted to its extended position.

9 Claims, 3 Drawing Sheets

FIG. 2
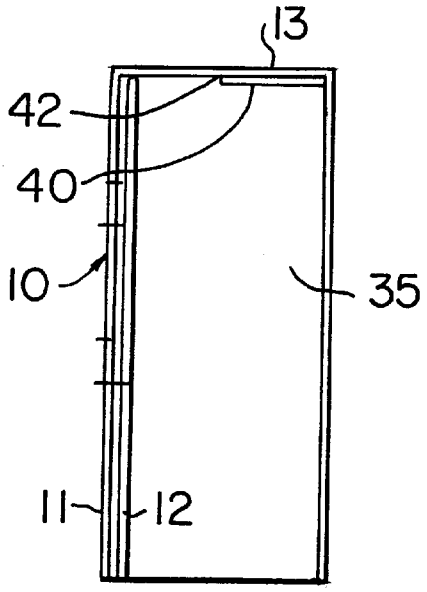
FIG. 3
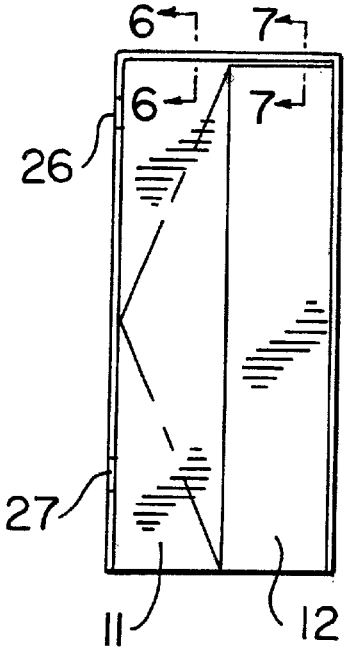
FIG. 5
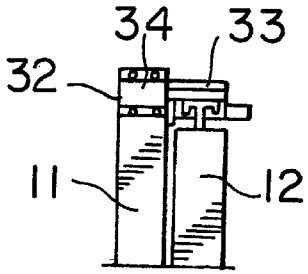
FIG. 4
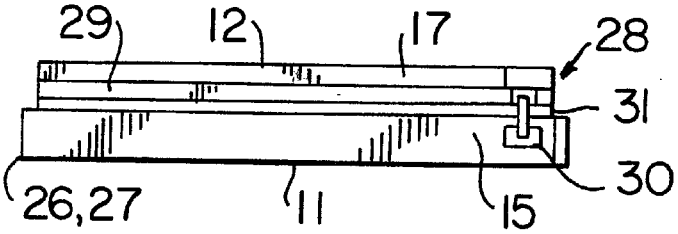
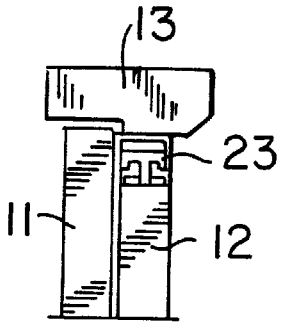
FIG. 6
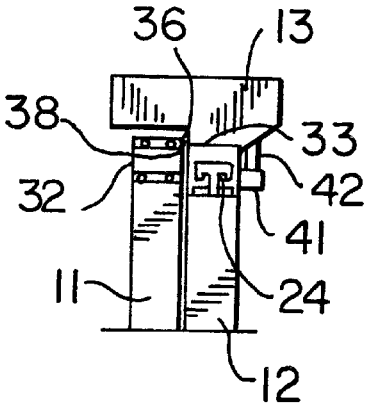
FIG. 7

DOOR ASSEMBLY

BACKGROUND OF THE INVENTION

Field of the Invention

The present invention relates to a door and door assembly. The invention has been developed especially, but not exclusively for internal access doors for residential or commercial use and the invention is herein described in that context. However it is to be appreciated that the invention has broader application and is not limited to that particular use.

Throughout the specification the term "door" is used to describe any structure that is operable to cover an opening and includes gates, shutters covers and the like. Moreover, throughout the specification the invention is described with reference to the orientation for use in internal access doors where the plane of the door is generally vertical. This however should not be construed as limiting the invention to that orientation, as the door may be used in other orientations. Accordingly, reference to a particular orientation is to be construed to encompass these other orientations.

DESCRIPTION OF THE PRIOR ART

In the design and construction of buildings, there is a continuing trend to maximise or increase the useable space. As a result, there is a continuing need for products which can allow savings in space, or be used in confined spaces. An aim of the present invention is to provide a door assembly which addresses this need.

SUMMARY OF THE INVENTION

Accordingly, the present invention provides a door assembly for use in a door frame defining an opening, the assembly including:

a door including a first generally planar panel arranged to be pivotally mounted to the door frame and movable between an open and a closed position, and a second panel which is connected to, and rotatable with, the first panel, the second panel being disposed generally parallel to, or co-planar with, the first panel, and movable thereto in the plane of the panels, such that the second panel is movable relative to the first panel between a retracted position wherein the second panel is generally laterally adjacent to the first panel, to an extended position wherein the second panel is spaced from the first panel in the direction of the plane of the panels;

a latching device operative to couple the first and second panels together so as to maintain the second panel in its retracted position;

a retaining device operable to couple the first panel to the door frame so as to retain the first panel in its closed position; and a track assembly interconnecting the first and second panels, the door assembly being operative to cover the opening defined by the door frame when in a fully closed position where the first panel is in its closed position and the second panel is in its extended position, and to allow passage through the opening when in a fully opened position where the first panel is in its open position and the second panel is in its retracted position;

characterised in that the track assembly being operative to prevent movement of the first panel from its closed position unless the second panel is in its retracted position, the latching device, when the second panel is in its retracted position, being operative to automatically couple the first and second panels together when the first panel is moved from its closed position, the latching device including a release mechanism operative to automatically release the second panel on rotation of the first panel to its closed position, and the retaining device being operative to be released on application of manual pressure to the first panel to rotate the door from its closed position, such that the door is manually operable to be moved between As fully opened position to its fully closed position solely by sequential movement of the first panel between its open and its closed position, and movement of the second panel between its retracted and its extended position.

A main advantage of the door according to the present invention is that the space required to allow the door to swing between an open and a closed position where the door covers an opening is substantially reduced as compared to conventional hinge doors for an opening of comparable size. This advantage comes about as the door can be rotated whilst the second panel is in the retracted position and then moved to an extended position once the door has rotated to its closed position. A further advantage of the present invention is that the door is easy to use, only requiring a simple two step process to move between its fully open to its fully closed position.

The panels of the door may be of any suitable shape though in most applications it is envisaged that they will be generally planar and have a rectangular profile which includes opposite ends which are spaced apart and interconnected by opposite sides. In this arrangement. preferably the first panel is adapted to be rotatably mounted to the support structure about an axis which extends generally in the direction of the opposite sides of the first panel and preferably the second panel is moveable relative to the first panel in a direction transverse to this axis.

Typically in the above arrangement, the door includes a hinge or similar linkage which allows the door to pivot about one of its sides and in a preferred form, the sides of the first panel are generally parallel to the sides of the second panel.

In a preferred form, the release mechanism of the latching device is adapted to the operatively associated with the support structure such as door jamb or the like so as to automatically release the second panel on rotation of the first panel to a predetermined position relative to the support structure.

In one form, the latching device includes a bar which is moveable between an engaged position wherein it interconnects the first and second panels to inhibit relative movement of the panels, to a release position where the bar is remote from the second panel. Preferably the latching device further includes a biasing spring to bias the bar into its engaged position.

In one form, the retaining device includes a biasing spring clip which is operable to be released on application of manual pressure to the first panel in a direction to rotate the door about the support structure from its predetermined position. This arrangement has the advantage that it facilitates easy release and engagement of the retaining device, without the need for separate manual activation of the retaining device to release the door to enable it to be rotated.

Preferably the first and second panels are interconnected by at least one track assembly which includes a track, and a runner which is captured within the track and slidable therein. In this arrangement the track is fixed to one of the first or second panels and the runner is connected to the other of the second panels.

In a preferred form, the door includes a pair of track assemblies, a respective one disposed at each of the opposite ends of the panels.

An advantage of a preferred form of the present invention is that the door is easy to operate. In particular, the second panel is adapted to be retained in its retracted position by the latching device when the door is other than in its closed position. Furthermore when the door is moved to its closed position it is retained in that position to thereby facilitate alignment of the track on the first panel with the track located on the door frame, thereby enabling easy movement of the second panel from Its retracted to its extended position.

Furthermore by having a track assembly located at the lower end of the panels ensure, that the panels remain generally in their parallel alignment.

DESCRIPTION OF THE DRAWINGS

It will be convenient to hereinafter describe an embodiment of the present invention with reference to the accompanying drawings. It is to be appreciated that the particularity of this description is not to be understood as superseding the generality of the preceding broad description of the invention.

In the drawings:

FIG. 2 is an elevation of the door of FIG. 1 in an open position;

FIG. 3 illustrates the door of FIG. 1 when in a closed position;

FIG. 4 is a bottom end view of the door of FIG. 1;

FIG. 5 is a sectional edge view of the top of the door of FIG. 2;

FIG. 6 is a sectional view along section line vi—vi of FIG. 3;

FIG. 7 is a sectional view along section line vii—vii of FIG. 3; and

DETAILED DESCRIPTION OF PREFERRED EMBODIMENTS

Figure 1:
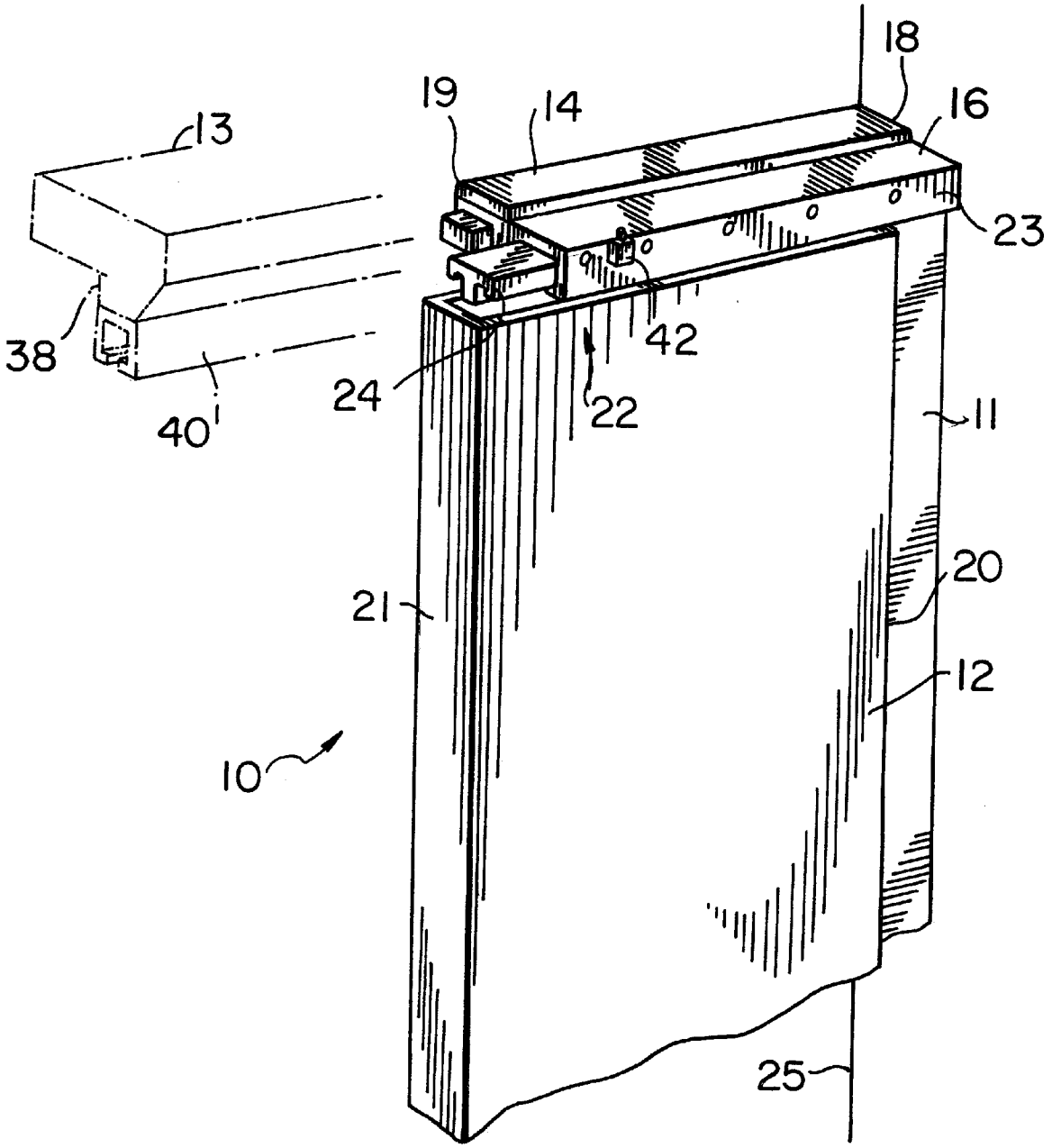
FIG. 1 is a partial perspective view of a door according to an embodiment of the invention and which incorporates an associated door frame shown in partial phantom view.

In relation to FIG. 1, a door 10 is disclosed which includes a first panel 11 and a second panel 12. The door is mounted to a door frame 13, which in FIG. 1 is only partially disclosed in phantom so as not to obscure the features of the door 10.

Both the first and second panel are generally planar and of rectangular shape having opposite ends 14, 15, 16 and 17 which are interconnected by opposite sides 18, 19, 20 and 21. The panels are interconnected so as to be in parallel alignment by a track rail assembly 22. The assembly 22 includes a track 23 fixed adjacent to an upper end 14 of the first panel 11 and a rail 24 extends from the upper end 16 and is captured within the track 23 so that the second panel is slidable relative to the first panel in the plane of the panels.

The first panel 11 is adapted to be hingedly mounted to the door frame 13 so as to be rotatable about a generally vertical axis 25 which extends along an inner side 18 of the first panel. In the illustrated form, the door 10 is connected to the door frame by hinges 26 and 27 as illustrated in FIG. 3. It is to be appreciated that any other form of appropriate coupling could be used.

As illustrated in FIG. 4, a second track assembly 28 is located at the bottom end of the first and second panels. In this arrangement, a track 29 having a generally C shaped profile is mounted on the bottom end 17 of the panel 12 and a guide runner 30 is mounted on the bottom end 15 of the first panel. The guide runner includes a wheel 31 which is received within the C shaped track. This arrangement prevents the panels from splaying apart at their lower end.

The second panel 12 is slidable relative to the first panel in the track assemblies 22, 28 between a retracted position where the panels are laterally adjacent and an extended position where the second panel is spaced from the first panel in the plane of the panels. FIG. 1 illustrates the second panel in a mid position between its retracted and extended positions. A plan view of the door with the second panel in the retracted position is illustrated in FIG. 9 whereas FIG. 10 illustrates the second panel 12 in its extended position.

The door 10 further includes a latching device 32 which is operable to retain the second panel in its retracted position. The device is mounted on the front side 19 of the first panel 11 and includes a spring biased bar 33 (as illustrated in FIG. 5) which is mounted in a housing 34 fixed to the first panel. The bar 33 is biased to extend out from the housing 34 so as to extend across the front side 21 of the second panel to thereby prevent that panel from sliding in the track assemblies 22 and 28 from its retracted position to its extended position. With this arrangement, the door is operable to be able to be easily pivoted about the hinges 26 and 27 whilst retaining the second panel in its retracted position.

Figure 8:
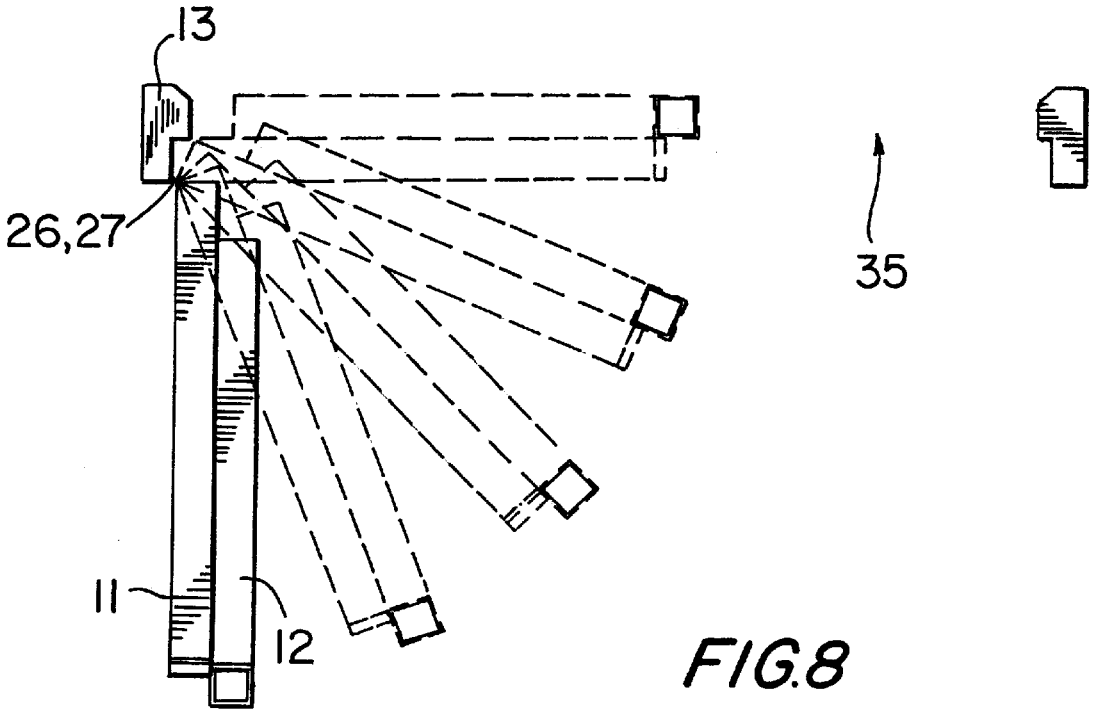
FIGS. 8 to 10 illustrate a plan view of the operation of the door of FIG. 1 to move from an open to a closed position.
Figure 9:
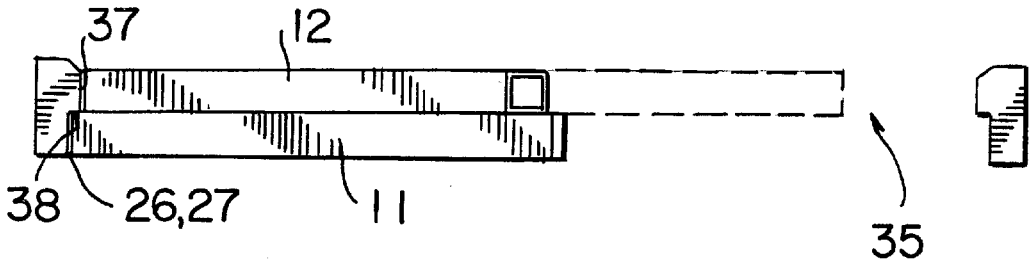
Figure 10:
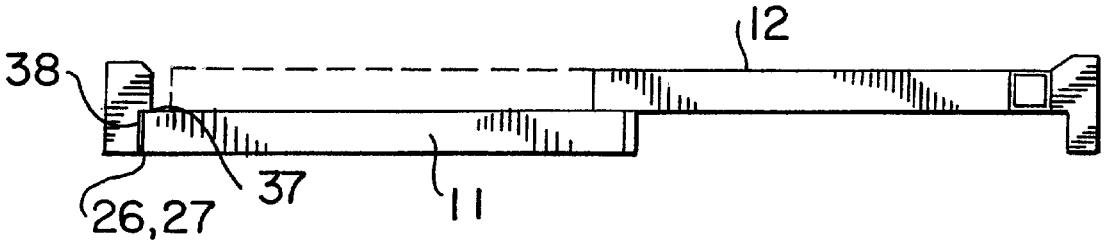

Turning to FIGS. 8 to 10, the first panel 11 is arranged to be pivoted about the hinges 26 and 27 relative to the door frame 13 from an open position (as shown in unbroken line in FIG. 8) where the door extends across the plane of the opening 35 defined by the door frame 13 to a closed position (as shown best in FIG. 9) where the door is in the plane of the opening 35.

With the second panel in the retracted position, movement of the first panel from the open to the closed position does not entirely cover the opening 35, this being achieved by the movement of the second panel from its retracted position to its extended position as best illustrated in FIG. 10. The various positions of the door are also shown in FIGS. 2 and 3 where in FIG. 2, the door is in the open position, and in FIG. 3 the door is fully closed having had the first panel rotated to the closed position and the second panel moved to its extended position.

The first panel is arranged to be slightly larger than the second panel so that an upper edge region 36 and a side edge region 37 extends beyond the second panel. As best illustrated in FIGS. 6 and 7, the upper edge region 36 is arranged to locate against or adjacent to an abutment surface 38 of the door frame 13, whereas as best illustrated in FIG. 9 and 10, the side edge region 37 is arranged to locate against a side surface 39 of the door frame 13 when the first panel is moved to its closed position. This configuration improves the sealing between the door 10 and the door frame 13.

The door frame 13 includes a top track 40 which on movement of the first panel 11 to the closed position is adapted to align with the track 23 of the track assembly 22. In aligning with the track 23 on movement of the first panel to the closed position, the door frame track is adapted to engage the bar 33 of the latching device 32 thereby causing it to be retracted against its spring biasing force into the housing 34. This arrangement is best illustrated in FIG. 7. This thereby releases the second panel 12 to enable it to slide relative to the first panel by the runner 24 being able to move within the aligned tracks 23, and 40.

The door also includes a retaining device 41 which is operable to maintain the first panel 11 in its closed position, so as to ensure that the tracks 23 and 40 remain correctly aligned. This facilitates the sliding of the second panel from its retracted to its extended position.

As shown in FIG. 7, in the illustrated form, the retaining device 41 includes a spring biased clip which is arranged to snap in over a tab 42 which extends from the door frame 13 when the first panel is moved to its closed position. The clip is shaped so as to be able to be cammed out of engagement with the tab 42 on moving the first panel from its closed position towards its open position. The advantage of this arrangement is that the retaining device does not individually need to be released to enable the door to be opened.

An advantage of the door 10 is that it can offer substantial savings in the space required to allow the door to swing between a fully opened to a fully closed position as compared to conventional hinge doors for a comparable opening size. Furthermore, the door is easy to operate. The second panel is arranged to be retained in its retracted position by the latching device thereby enabling the panels to rotate about the hinges 26, 27 without any inadvertent movement between the panels. Furthermore when the door is moved to its closed position it is retained in that position by the retaining device which facilitates the correct alignment of the track of the first panel with the track located on the door frame, thereby enabling easy movement of the second panel from its retracted to its extended position. Also on movement of the first panel to the closed position it is arranged to automatically release the latching the device thereby enabling the door to be moved from a fully open position to a closed position in two easy steps, the first being rotation of the first panel to the closed position the second being movement of the second panel from its retracted to its extended position.

It is to be appreciated that variations and modifications may be made to the parts previously described without departing from the spirit or ambit of the invention. In particular, it is to be appreciated that the first panel may include a cavity which is adapted to receive the second panel so that the two panels are co-planar. Furthermore the coupling arrangement between the first and second panels which enables the second panel to move from its retracted to its extended position can also take other forms as will be appreciated by those skilled in the art.

What is claimed is:

1. A door assembly for use in a door frame defining an opening, the assembly including:

a door including a first generally planar panel arranged to be pivotally mounted to the door frame and movable between an open and a closed position, and a second panel which is connected to, and rotatable with, said first panel, the second panel being disposed generally parallel to, or co-planar with, said first panel, and movable thereto in the plane of the panels, such that the second panel is movable relative to the first panel between a retracted position wherein the second panel is generally laterally adjacent to the first panel, and an extended position wherein the second panel is spaced from the first panel in the direction of the plane of the panels;

a latching device operative to couple the first and second panels together so as to maintain the second panel in its retracted position;

a retaining device operable to couple the first panel to the door frame so as to retain the first panel in its closed position; and a track assembly interconnecting the first and second panels for movement of said second panel between its retracted and extended positions, the door assembly being operative to cover the opening defined by the door frame when in a fully closed position where the first panel is in its closed position and the second panel is in its extended position, and to allow passage through the opening when in a fully opened position where the first panel is in its open position and the second panel is in its retracted position;

characterized in that the second panel when moved toward its extended position in the track assembly is disposed for engagement with the door frame to prevent movement of the first panel from its closed position unless the second panel is in its retracted position, the latching device, when the second panel is in its retracted position, being operative to automatically couple the first and second panels together when the first panel is moved from its closed position, the latching device including a release mechanism operative to automatically release the second panel on rotation of the first panel to its closed position, and the retaining device being operative to be released on application of manual pressure to the first panel to rotate the door from its closed position, such that the door is manually operable to be moved between its fully opened position to its fully closed position solely by sequential movement of the first panel between its open and its closed position, and movement of the second panel between its retracted and its extended position.

2. A door assembly according to claim 1, wherein each of the panels is generally rectangular having opposite ends which are spaced apart and interconnected by opposite sides, and wherein the first panel is adapted to be rotatably mounted to the door frame about an axis which extends generally in the direction of the opposite sides of said first panel, and wherein the second panel is moveable relative to the first panel in a direction transverse to said axis.

3. A door assembly according to claim 2, wherein the sides of the first panel are generally parallel to the sides of the second panel.

4. A door assembly according to claim 1, wherein the latching device includes a bar which is movable between an engaged position wherein it interconnects the first and second panels to inhibit relative movement of the panels, to a release position where the bar is remote from said second panel, the latching device including a biasing spring to bias the bar into its engaged position, and wherein the bar is adapted to move from the engaged position to the released position by engagement of the bar with an abutment surface connected to, or integrally formed with, the door frame on movement of the first panel to its closed position.

5. A door assembly according to claim 1, wherein the retaining device includes a spring biasing clip which is operable to be released on the application of manual pressure to the first panel to rotate the door from the closed position to its open position.

6. A door assembly according to claim 1, wherein the track assembly is located at or adjacent an upper end of the respective panels, and includes a first track mounted on the first panel and a runner which is connected to the second panel and which is captured within the first track and slidable therein.

7. A door assembly according to claim 6, wherein the track assembly further includes a second track connected to the door frame, and wherein on movement of the first panel to the closed position, the second track is adapted to align with the track on the first panel so as to enable the runner connected to the second panel to slide between the first and second tracks and wherein engagement of the runner in said second track prevents movement of the first panel from its closed position.

8. A door assembly according to claim 7, wherein the first and second panels include a second said track assembly located at a lower end of the respective panels, said second track assembly being adapted to interconnect said first and second panels and include a track mounted on one of said panels and a runner mounted on the other of said panels which is captured within the track of the second track assembly and slidable therein.

9. A door assembly according to claim 6, wherein the first and second panels include a second said track assembly located at a lower end of the respective panels, said second track assembly being adapted to interconnect said first and second panels and include a track mounted on one of said panels and a runner mounted on the other of said panels which is captured within the track of the second track assembly and slidable therein.

* * * * *